US008487554B2

(12) United States Patent
Sauerlaender et al.

(10) Patent No.: US 8,487,554 B2
(45) Date of Patent: Jul. 16, 2013

(54) ILLUMINATION DEVICE COMPRISING MULTIPLE LEDS

(75) Inventors: Georg Sauerlaender, Aachen (DE); Harald Josef Gunther Radermacher, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 242 days.

(21) Appl. No.: 13/055,237

(22) PCT Filed: Jul. 23, 2009

(86) PCT No.: PCT/IB2009/053198

§ 371 (c)(1),
(2), (4) Date: Jan. 21, 2011

(87) PCT Pub. No.: WO2010/013177

PCT Pub. Date: Feb. 4, 2010

(65) Prior Publication Data

US 2011/0133658 A1 Jun. 9, 2011

(30) Foreign Application Priority Data

Jul. 29, 2008 (EP) ..... 08161317
Feb. 20, 2009 (EP) ..... 09153286

(51) Int. Cl.
*H05B 37/02* (2006.01)

(52) U.S. Cl.
USPC ..... 315/308; 315/209 R; 315/312

(58) Field of Classification Search
USPC ..... 315/119, 121, 125, 185 R–193, 209 R, 315/210, 211, 225, 226, 291, 307, 308, 312–315, 318, 360–362; 362/249.01, 800; 345/84, 90, 93, 204, 210–214
See application file for complete search history.

(56) References Cited

U.S. PATENT DOCUMENTS

| | | | | |
|---|---|---|---|---|
| 3,714,374 | A | 1/1973 | Sobel | |
| 7,723,926 | B2 * | 5/2010 | Mednik et al. | 315/291 |
| 2005/0218838 | A1 * | 10/2005 | Lys | 315/291 |
| 2006/0038803 | A1 * | 2/2006 | Miller et al. | 345/204 |
| 2007/0024213 | A1 * | 2/2007 | Shteynberg et al. | 315/291 |
| 2007/0145914 | A1 | 6/2007 | Hong et al. | |

FOREIGN PATENT DOCUMENTS

| | | | |
|---|---|---|---|
| DE | 102006024607 | A1 | 11/2007 |
| DE | 102007006438 | A1 | 8/2008 |
| EP | 0410695 | A2 | 1/1991 |
| WO | 2010013172 | A1 | 2/2010 |

* cited by examiner

*Primary Examiner* — Jimmy Vu
(74) *Attorney, Agent, or Firm* — Mark L. Beloborodov

(57) ABSTRACT

A light generating device (20) comprises: —an input for receiving a DC input voltage (Vin) of varying magnitude; —a controllable current source (40); —a switch matrix (30) comprising a plurality of controllable switches (S1-SN); —a plurality of n LEDs (D1, D2, . . . Dn) connected to output terminals of the switch matrix (30); —a controller (50) controlling said switches and controlling the current generated by the current source dependent on the momentary value of the DC input voltage (Vin). The controller is capable of operating in at least three different control states. In a first control state all LEDs are connected in parallel. In a second control state all LEDs are connected in series. In a third control state at least two of said LEDs are connected in parallel while also at least two of said LEDs are connected in series.

7 Claims, 4 Drawing Sheets

ILLUMINATION DEVICE COMPRISING MULTIPLE LEDS

FIELD OF THE INVENTION

The present invention relates in general to a lighting device comprising a plurality of LEDs. The present invention relates particularly to a device for use in automobiles, suitable for providing tail light, brake light or turn signal light.

BACKGROUND OF THE INVENTION

In general, the use of LEDs for illumination purposes is known. A problem with LEDs is the power supply; it is noted that the power supply in a car is provided by the car's battery, typically providing a voltage in the order of 6 V or 12 V or 24 V. For a LED to produce light, it requires a current to pass through it in one direction (from anode to cathode); current flow in the opposite direction is blocked. When driven with current having the correct direction, a voltage drop develops over the LED which is substantially independent of the LED current. Within margins, the LED current can be varied, and the light output will be substantially proportional to this current. When it is desirable to produce more light than one LED can generate, it is possible to combine multiple LEDs. The LEDs can be arranged in a series arrangement, which would require a higher voltage drop at the same current, or the LEDs can be arranged in a parallel arrangement, which requires more current at the same voltage drop. Thus, the costs of power supply increase. Combinations of series arrangement and parallel arrangement are also possible.

A relatively simple and cheap way of powering a plurality of LEDs is to connect all LEDs in series and to connect this string to the battery, having a current limiting resistor in series. A problem when powering a LED or a string of LEDs directly from a car battery is that the supply voltage may change substantially with time. FIG. 1 is a graph showing a relationship between supply voltage and LED current. A horizontal dotted line 11 represents the required voltage drop, also indicated as forward voltage, over a string of LEDs. Curve 12 represents battery voltage. Assume that the horizontal axis represents time. Assume that in period A the car's motor is off and the battery voltage is nominal and higher than the required voltage drop: the LEDs pass a current (curve 13) and light is generated. The difference between supply voltage and voltage drop is accommodated by the series resistor, and involves loss of energy by dissipation in the resistor. Assume that in period B the car's motor is being started so that the battery voltage drops and becomes lower than the required voltage drop: the LEDs can not pass current and can not generate light. Assume that in period C the motor is running and the battery voltage is higher than nominal: the series resistor needs to accommodate more voltage, thus the power dissipated in the resistor will increase.

SUMMARY OF THE INVENTION

An object of the present invention is to provide a solution to the above-mentioned problems.

German Offenlegungsschrift 10.2006.024607 discloses a circuit comprising two strings of series-connected LEDs and three controllable switches, powered from a DC power source of which the actual voltage may vary, depending on circumstances. The power voltage is measured, and compared with a threshold. If the power voltage is above the threshold, the switches are controlled such that the two strings are connected in series. If the power voltage is below the threshold, the switches are controlled such that the two strings are connected in parallel. In order to assure that the current in the LEDs remains constant, independent of the strings being connected in series or in parallel, each string must have a dedicated current source connected in series with it. Further, this known circuit has only two possible configurations.

Thus, it is an object of the present invention to further improve on said prior art.

In one aspect, the present invention provides a system of at least three groups of LEDs, coupled together by controllable switches, capable of being switched to any of at least three states:

in a first state, all groups are connected in series;

in a second state, all groups are connected in parallel;

in a third state, at least two groups are connected in series and at least two groups are connected in parallel.

In a second aspect, the system comprises a controllable current source in common for all LEDs. The current setting of the current source is amended in conjunction with the state of the switches, such as to keep the individual LED current substantially constant.

Further advantageous elaborations are mentioned in the dependent claims. It is noted that German Offenlegungsschrift 10.2007.006438 discloses a circuit comprising multiple strings of LEDs with switches to change from more strings with two LEDs in series to less strings with more LEDs in series. In the proposal of this document, however, there is always one current source for each string; in contrast, in the proposal of the present invention there is only one common current source. Further, depending on the switching state, the number of switches in series with the LEDs may vary between different strings, which is a disadvantage because each switch has a certain voltage drop so the current distribution between the LEDs will vary if the number of switches in series with the LEDs varies.

The present invention also aims to overcome these disadvantages.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
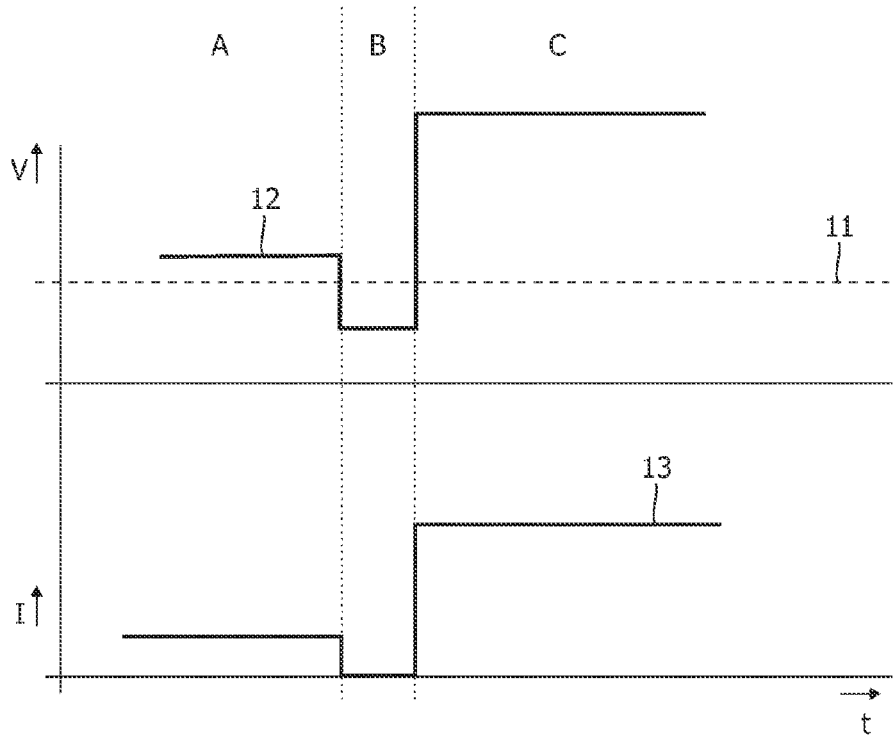
FIG. 1 PRIOR ART
FIG. 1 is a graph showing a relationship between supply voltage and LED current for a prior art solution.
Figure 2:
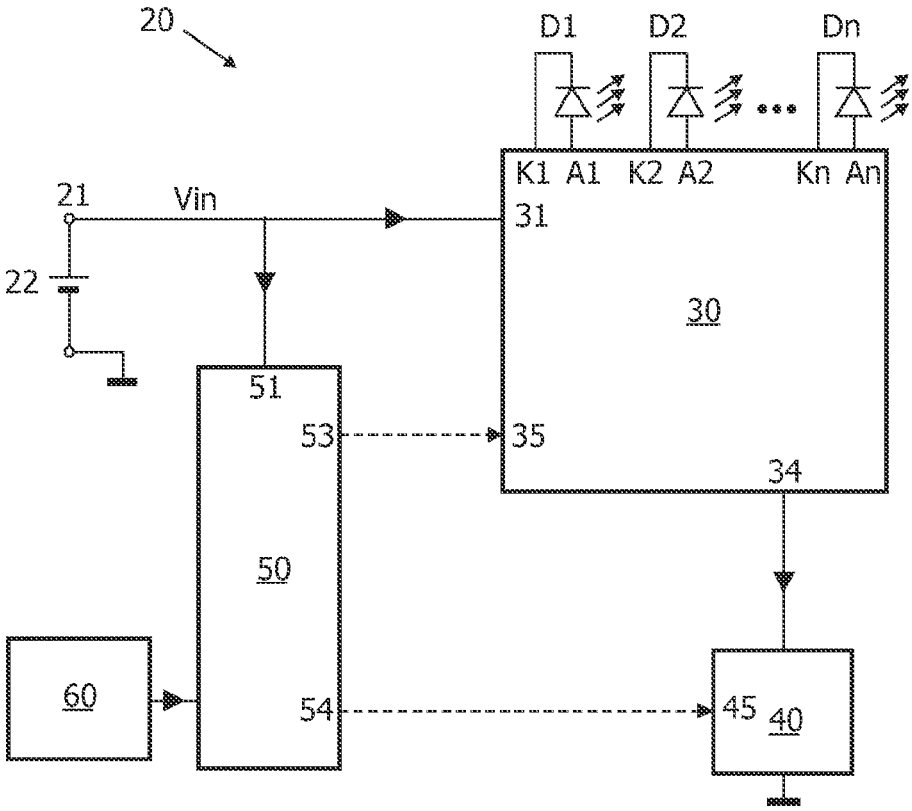
FIG. 2 is a block diagram schematically illustrating an illumination device according to the present invention.

FIG. 2 is a block diagram schematically illustrating an illumination device 20 according to the present invention. The device 20 has an input 21 for connection to a car battery 22 (or, in practice, a power bus connected to the battery), supplying 12 V DC.

D1, D2, . . . Dn indicate respective groups of LEDs. Each group may consist of only one LED. Each group may also comprise a plurality of LEDs connected in series and/or in parallel. It is preferred that the groups are mutually identical, but this is not essential. For sake of simplicity, each group will hereinafter be discussed as if it is identical to one single LED.

The LEDs D1, D2, . . . Dn have their terminals connected to output terminals A1 and K1, A2 and K2, . . . An and Kn of a switch matrix 30 which comprises a plurality of N switches S1-SN, as will be discussed later. The switch matrix 30 has an input 31 coupled to the input 21 such as to receive the bus DC voltage.

The device 20 further has a controllable current source 40 coupled in series with the switch matrix 30.

The device 20 further has a controller 50 having an input 51 coupled to the input 21 such as to receive the bus DC voltage. The controller 50 has a first output 53 coupled to a control input 35 of the switch matrix 30 in order to control the configuration of the switches of the switch matrix 30, as will be discussed later. The controller 50 has a second output 54 coupled to a control input 45 of the controllable current source 40 in order to control the current magnitude. It is noted that each individual switch will have an individual control terminal, and that the first output 53 will actually comprise a plurality of output terminals (not shown) each being coupled to a respective one of the control terminals of the respective switches, as should be clear to a person skilled in the art; thus, the controller 50 is capable of individually controlling the state of each individual switch in the switch matrix.

Figure 3:
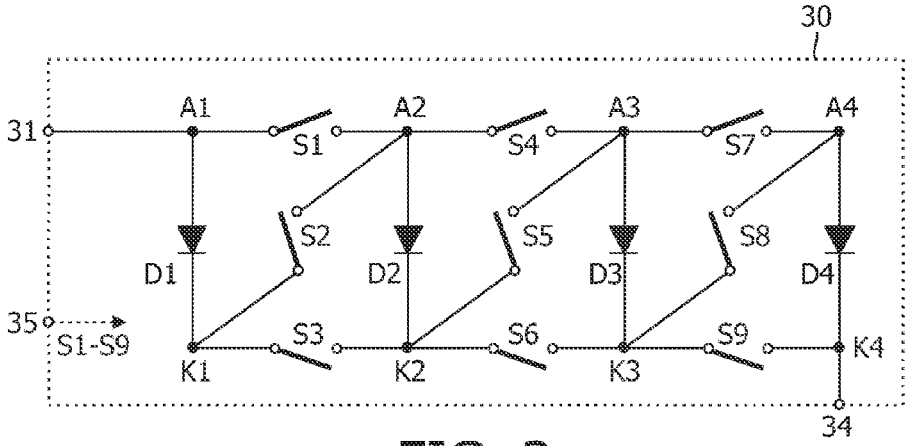
FIG. 3 is a block diagram of a switch matrix.

FIG. 3 is a block diagram of a possible embodiment of the switch matrix 30 for an exemplary embodiment of the device 20 comprising four LEDs D1, D2, D3, D4. For sake of clarity, these LEDs are also shown in FIG. 3. In this embodiment, the switch matrix 30 comprises nine controllable switches S1-S9. Each switch can be implemented as a bipolar transistor, a FET, or the like, although it is also possible that a switch is implemented as a relay. Since such switches are known per se, a more detailed description is not needed here. It is noted that each switch will have an individual control terminal individually addressable by the controller 50, but these individual control terminals and the corresponding control lines connecting to the controller 50 are not shown for sake of simplicity.

Anode terminals for connecting to the anodes of the LEDs D1-D4 are indicated at A1-A4, respectively. Cathode terminals for connecting to the cathodes of the LEDs D1-D4 are indicated at K1-K4, respectively. Assuming that the voltage received at input 31 is positive, voltage input terminal 31 is connected to a first anode terminal A1. A first switch S1 is connected between the first anode terminal A1 and a second anode terminal A2.

A second switch S2 is connected between a first cathode terminal K1 and the second anode terminal A2.

A third switch S3 is connected between the first cathode terminal K1 and a second cathode terminal K2.

A fourth switch S4 is connected between the second anode terminal A2 and a third anode terminal A3.

A fifth switch S5 is connected between the second cathode terminal K2 and the third anode terminal A3.

A sixth switch S6 is connected between the second cathode terminal K2 and a third cathode terminal K3.

A seventh switch S7 is connected between the third anode terminal A3 and a fourth anode terminal A4.

An eighth switch S8 is connected between the third cathode terminal K3 and the fourth anode terminal A4.

A ninth switch S9 is connected between the third cathode terminal K3 and a fourth cathode terminal K4.

A current input terminal 34, connecting to the current source 40, is connected to the fourth cathode terminal K4.

In the following, a switch will be indicated as "closed" if it is in its conductive state and will be indicated as "open" if it is in its non-conductive state.

Figure 4A:
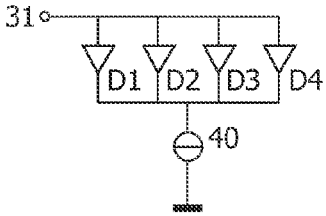
FIGS. 4A-4D illustrate several switch states.

The controller 50 can operate at least in four different control states. In a first control state, the controller 50 generates control signals for the switches S1-S9 so that the switches S1, S4, S7, S3, S6, S9 are closed and switches S2, S5, S8 are open. In this state, all LEDs are connected in parallel, as illustrated in FIG. 4A. For each LED, it is possible to consider the current path from terminal 31 to terminal 34: it can easily be seen that each such current path always comprises three closed switches in series.

Figure 4B:
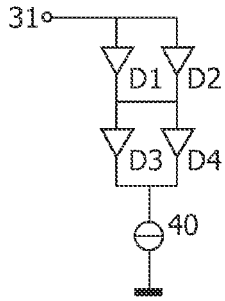

In a second control state, the controller 50 generates control signals for the switches S1-S9 so that the switches S1, S3, S5, S7, S9 are closed and switches S2, S4, S6, S8 are open. In this state, LEDs D1 and D2 are connected in parallel, LEDs D3 and D4 are connected in parallel, and said parallel arrangements are connected in series, as illustrated in FIG. 4B. Again, it can easily be seen that, for each LED, the corresponding current path from terminal 31 to terminal 34 always comprises three closed switches in series.

Figure 4C:
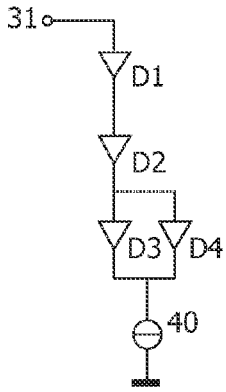

In a third control state, the controller 50 generates control signals for the switches S1-S9 so that the switches S2, S5, S9 are closed and switches S1, S3, S4, S6, S8 are open. In this state, three LEDs D1, D2, D3 are connected in series, as illustrated in FIG. 4C. Regarding D4, there are two variations possible. In a first variation, S7 is open, as illustrated in FIG. 4C; in this variation, the three LEDs D1, D2, D3 all receive the same current and consequently emit all the same amount of light, while the fourth LED D4 does not receive any power. In a second variation, S7 is closed, as illustrated in FIG. 4C by a dotted line between the anodes of D3 and D4, so that D3 and D4 are connected in parallel. In this second variation, all LEDs emit light, but LEDs D3 and D4 each receive half the current as compared to D1 and D2 and consequently emit about half as much light as D1 and D2 do. It is noted, however, that the second variation may result in an improved overall light output, if the LEDs suffer from the so-called droop effect, which means that the light output is less than proportional to the current.

There are of course more variations. It is possible that D1, D2, D4 are connected in series by closing S2, S6, S8 and opening S1, S3, S4, S5, S7, S9, with D3 being optionally coupled in parallel to D2 by closing S4, or by closing S2, S5, S7 and opening S1, S3, S4, S6, S8, S9, with D3 being optionally coupled in parallel to D4 by closing S9. It is possible that D1, D3, D4 are connected in series by closing S3, S5, S8 and opening S1, S2, S4, S6, S7, S9, with D2 being optionally coupled in parallel to D1 by closing S1, or by closing S2, S4, S8 and opening S1, S3, S5, S6, S7, S9, with D2 being optionally coupled in parallel to D3 by closing S6. It is possible that D2, D3, D4 are connected in series by closing S1, S5, S8 and opening S2, S3, S4, S6, S7, S9, with D1 being optionally coupled in parallel to D2 by closing S3. If it is desirable that the array of LEDs appears to a viewer as being uniformly lit, it is possible for the controller to quickly alternate between such variations, either in a fixed order or in a random order.

Again, for all of these variations it can easily be seen that, for each LED, the corresponding current path from terminal 31 to terminal 34 always comprises three closed switches in series.

Figure 4D:
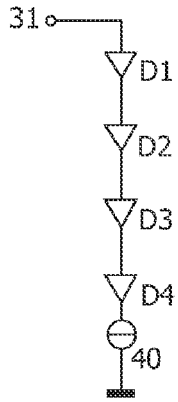

In a fourth control state, the controller 50 generates control signals for the switches S1-S9 so that the switches S2, S5, S8 are closed and switches S1, S4, S7, S3, S6, S9 are open. In this state, all LEDs are connected in series, as illustrated in FIG. 4D. Again, it can easily be seen that the current path from terminal 31 to terminal 34 always three closed switches in series.

If desired, the controller may be capable of operating in a fifth control state in which all switches are open so that all LEDs are off, although it is also possible to achieve this effect by (for instance) having switches S1, S2, S3 be open: in that case, the state of the remaining switches is immaterial.

Figure 5:
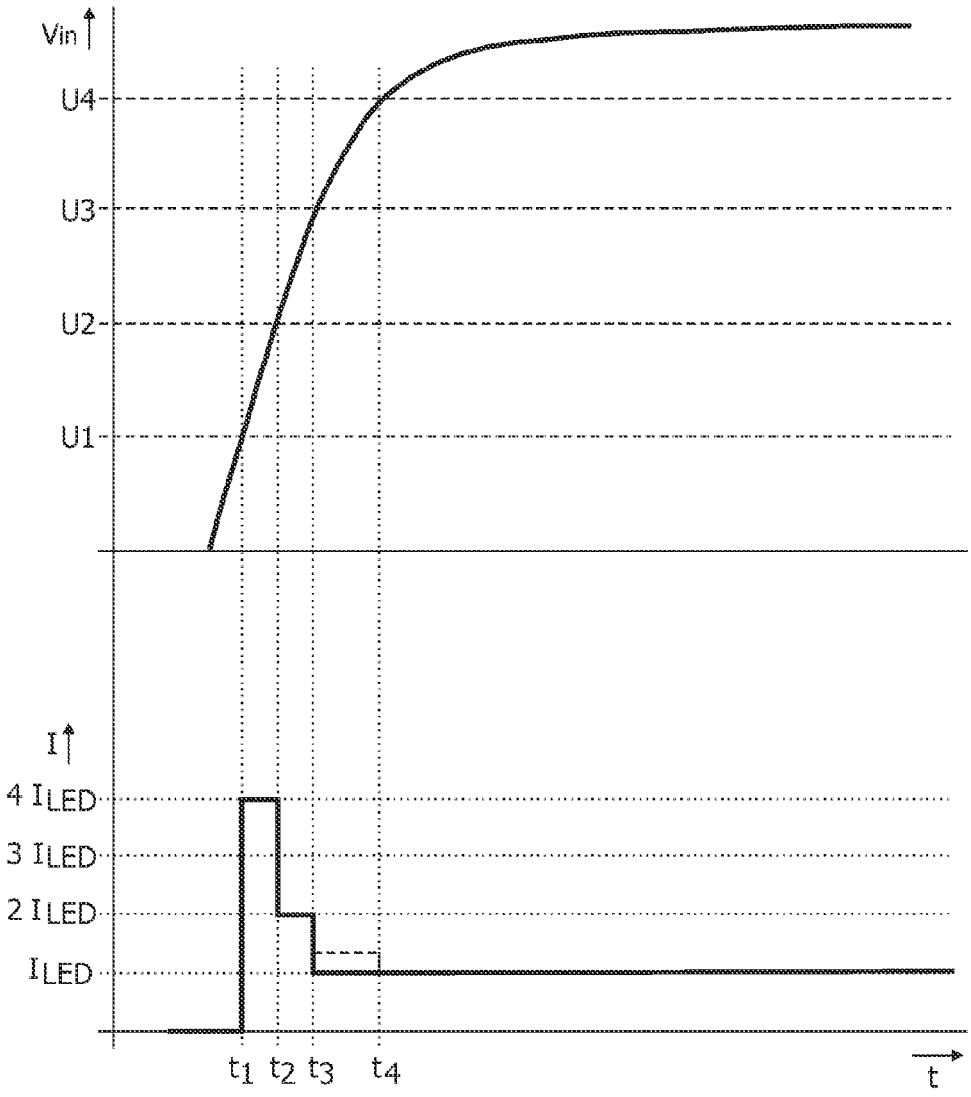
FIG. 5 is a graph illustrating the operation of the illumination device according to the present invention.

For explaining the operation of the controller 50, reference is made to FIG. 5, which is a graph illustrating the behaviour of the system as a function of the voltage Vin received at the voltage input 31 of the switch matrix 30. In the following explanation, it will be assumed that the controller 50 receives the same voltage Vin at its voltage input 51, but a similar explanation with obvious modifications will apply if the controller 50 receives a measuring voltage Vm proportional to Vin. Although such measuring voltage may be higher than Vin, it would be preferred that the measuring voltage is lower than Vin and can be expressed as $Vm=\mu \cdot Vin$, with $0<\mu<1$. Further, it will be assumed that all LEDs have the same forward voltage, indicated as Vf.

Assume that Vin is relatively low, particularly lower than Vf, i.e. too low to drive any LED. In order to assure that individual tolerances of the LEDs do not cause irregular behaviour, it is preferred that the controller 50 is in a ground state in which all LEDs are off, for instance by all switches S1-S9 being open.

The controller 50 is provided with a memory 60, which contains information defining four threshold levels U1, U2, U3, U4. The first threshold level U1 corresponds to the voltage required for driving one LED. It is noted that this voltage is typically higher than Vf, for instance because it also includes the voltage drops over the three switches that are always connected in series with any of the LEDs, and the voltage drop over a shunt resistor (not shown) for measuring the current. Likewise, the second threshold voltage U2 corresponds to the voltage required for driving two LEDs in series, which is typically somewhat higher than 2·Vf. Likewise, the third threshold voltage U3 corresponds to the voltage required for driving three LEDs in series, which is typically somewhat higher than 3·Vf. Likewise, the fourth threshold voltage U4 corresponds to the voltage required for driving four LEDs in series, which is typically somewhat higher than 4·Vf.

In general, the i-th threshold voltage Ui can be approximated as $$Ui=i \cdot Vf+\gamma \quad (1)$$

for i=1 to n, n indicating the number of LED groups, wherein $\gamma$ is a constant that can be approximated as $\gamma=3\alpha+\beta+\delta$, wherein $\alpha$ represents the voltage drop over a switch, $\beta$ represents the voltage drop over a shunt resistor, and $\delta$ represents the minimum voltage drop required by the current source to stay in control. It is noted that it is also possible that the memory 60 only contains Vf and $\alpha$ and $\beta$ and $\delta$, and that the controller is capable of calculating Ui. It is further noted that $\gamma$ depends on the actual configuration of the switch matrix, and may even depend on the control state, as should be clear to a person skilled in the art with reference to the above explanation.

The controller 50 compares Vin with the threshold levels Ui. If Vin>U1, the voltage is high enough for driving at least one LED. If Vin>U2, the voltage is high enough for driving at least two LEDs in series. If Vin>U3, the voltage is high enough for driving at least three LEDs in series. If Vin>U4, the voltage is high enough for driving at least four LEDs in series. In general, if Vin>Ui, the voltage is high enough for driving at least i LEDs in series.

If the controller finds that U1≦Vin<U2, which will be the case from $t_1$ to $t_2$, it switches to its first control state such as to switch all LEDs in parallel, as illustrated in FIG. 4A. Further, in this first control state it generates its control signal for the controllable current source 40 such that the current source 40 provides a current $I=4 \cdot I_{LED}$, with $I_{LED}$ indicating a nominal LED current, so that each LED receives $I_{LED}$.

If the controller finds that U2≦Vin<U3, which will be the case from $t_2$ to $t_3$, it switches to its second control state such as to switch the LEDs to a series arrangement of two LED groups, each groups containing two LEDs in parallel, as illustrated in FIG. 4B. This is equivalent to a parallel arrangement of two LED strings, each LED string comprising two LEDs in series. Further, in this second control state the controller generates its control signal for the controllable current source 40 such that the current source 40 provides a current $I=2 \cdot I_{LED}$, so that each LED string receives $I_{LED}$.

If the controller finds that U3≦Vin<U4, which will be the case from $t_3$ to $t_4$, it switches to its third control state such as to switch the LEDs to an arrangement of three LEDs in series, as illustrated in FIG. 4C. Further, in this third control state the controller generates its control signal for the controllable current source 40 such that the current source 40 provides a current $I=I_{LED}$. As mentioned earlier, the fourth LED D4 may be coupled in parallel to the third LED D3.

If the controller finds that U4≦Vin, which will be the case from $t_4$ onwards, it switches to its fourth control state such as to switch all LEDs in series, as illustrated in FIG. 4D. Further, in this fourth control state it generates its control signal for the controllable current source 40 such that the current source 40 provides a current $I=I_{LED}$.

As also mentioned earlier, the third control state may involve variations with another group of three LEDs being coupled in series. In any case, there are always only three LEDs on with the fourth one being off, or the fourth one is coupled in parallel to one of its neighbours and both are operated at half current, basically again adding up to three times nominal light output. This corresponds to a reduction in overall light output of 25%. If it is desirable that the overall light output remains substantially constant, it is possible for the controller to increase the LED current by 33%, as illustrated in FIG. 5 by the dotted lines in the time interval $t_3$-$t_4$.

In the above example, the device 20 comprises four (groups of) LEDs D1-D4. However, the invention can be implemented for any number of (groups of) LEDs D1-Dn. Although more complicated designs of the switch matrix are possible, a higher number of LEDs can easily be accommodated by extending the matrix design of FIG. 3, which is modular; the corresponding modification to equation (1) should be clear to a person skilled in the art. For each LED that is added, three additional switches are needed. In general, with n indicating the number of (groups of) LEDs, n being equal to 2 or higher, and N indicating the number of switches, N being equal to 3n−3, the following applies for the m-th LED, 2≦m≦n:

a) a controllable switch Sx connects anode Am of LED Dm to anode A(m−1) of LED D(m−1);

b) a controllable switch Sy connects anode Am of LED Dm to cathode K(m−1) of LED D(m−1);

c) a controllable switch Sz connects cathode Km of LED Dm to cathode K(m−1) of LED D(m−1);

with x=3(m−2)+1, y=3(m−2)+2, z=3(m−2)+3.

Depending on the value of n, it will be possible to operate in a state with n LEDs in parallel (i.e. n parallel strings each having one LED "in series"), one string of n LEDs in series, one string of n−1 LEDs in series, one string of n−2 LEDs in series, two strings of n/2 LEDs (or less) in series, three strings of n/3 LEDs (or less) in series, etc. Further, for each current path for each LED, the number of closed switches in series is always equal to n−1.

For instance, with n=10, it is possible to have 10 LEDs in parallel; the controller sets the current source to provide $10 \cdot I_{LED}$. If the voltage increases, it becomes possible to have five times two LEDs in series; the controller sets the current source to provide $5 \cdot I_{LED}$. If the voltage increases further, it becomes possible to have three times three LEDs in series. One of the LEDs may be inoperative, but, similarly as discussed earlier, it is also possible to have two groups of three parallel LEDs and one group of four parallel LEDs. The controller sets the current source to provide $3 \cdot I_{LED}$, or optionally the current may be increased by 10% in order to keep constant the overall light output.

If the voltage increases further, it becomes possible to have two times four LEDs in series. Again, two of the LEDs may be inoperative, but, similarly as discussed earlier, it is also possible to have two groups of two parallel LEDs and two groups of three parallel LEDs. The controller sets the current source to provide $2 \cdot I_{LED}$, or optionally the current may be increased by 20% in order to keep constant the overall light output.

If the voltage increases further, it becomes possible to have two times five LEDs in series; the controller sets the current source to provide $2 \cdot I_{LED}$. If the voltage increases further, it becomes possible to have one times six LEDs in series; the controller sets the current source to provide $1 \cdot I_{LED}$. This also applies of the voltage rises further so that 7, 8, 9 and 10 LEDs can be connected in series (with 3, 2, 1 and 0 being inoperative or optionally connected in parallel).

In all cases, the controller will control the switch matrix so that strings are formed of $n_S$ LEDs in series, with $n_S$ being the highest number possible in view of the input voltage: $n_S \cdot Vf \leqq Vin < (n_S+1) \cdot Vf$ (here, $\alpha$ and $\beta$ and $\delta$ are ignored for sake of simplicity). Further, the number $n_P$ of such strings will be as high as possible: $n_P \cdot n_S \leqq n < (n_P+1) \cdot n_S$; the controller will control the current source such as to provide current $I = n_P \cdot I_{LED}$.

Summarizing, the present invention provides a light generating device 20, comprising:

an input for receiving a DC input voltage Vin of varying magnitude;

a controllable current source 40;

a switch matrix 30 comprising a plurality of controllable switches S1-SN;

a plurality of n LEDs D1, D2, . . . Dn connected to output terminals of the switch matrix 30;

a controller 50 controlling said switches and controlling the current generated by the current source dependent on the momentary value of the DC input voltage Vin. The controller is capable of operating in at least three different control states. In a first control state all LEDs are connected in parallel. In a second control state all LEDs are connected in series. In a third control state at least two of said LEDs are connected in parallel while also at least two of said LEDs are connected in series.

In a further embodiment, the device is protected against the input voltage rising too high. In the situation of a car battery, it may happen that the input voltage rises above 16 V. According to the invention, the controller is capable of comparing the input voltage Vin with a predetermined maximum threshold voltage Vmax of, for instance, 16 V. As long as the input voltage is lower than the threshold voltage, the operation is as described above. If the input voltage Vin is higher than the threshold voltage Vmax, the controller controls the current magnitude of the current source 40 in such a way that the total power drawn by the device is constant, rather than constant current. In other words, the controller calculates the current magnitude I of the current source 40 according to I=P/Vin, with P being a predetermined constant.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, the rectified voltage may also be negative polarity.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. A light generating device (20), comprising:

an input (21) for connecting to a DC voltage source (22) of which the voltage (Vin) is varied;

a controllable current source (40);

a switch matrix (30) comprising a plurality of controllable switches (S1-SN), the matrix having a voltage input terminal (31) coupled to said device input (21) for receiving the input DC voltage (Vin) and having a current input terminal (34) coupled to the current source (40);

a plurality of n LED groups (D1, D2, . . . Dn), each group comprising a plurality of LEDs connected in series and/or in parallel, each LED group being connected to output terminals (A1, K1; A2, K2; A3, K3; . . . An, Kn) of the switch matrix (30);

a controller (50) having an input (51) coupled to said device input (21) for receiving a signal indicating the momentary value of the DC input voltage (Vin), having a first control output (53) coupled to the switches (S1-SN) of the switch matrix (30) for controlling the switch state of these switches (S1-SN), and having a second control output (54) coupled to the controllable current source (40) for controlling the current generated by the current source;

wherein the controller is configured to control the switch state of the switches (S1-SN) and the current generated by the current source dependent on the momentary value of the DC input voltage (Vin);

wherein the controller is capable of operating in at least three different control states, wherein in a first one of said control states the switches (S1-SN) are put is a state so that all LED groups (D1, D2, . . . Dn) are mutually connected in parallel, wherein in a second one of said control states the switches (S1-SN) are put is a state so that all LED groups (D1, D2, . . . Dn) are mutually connected in series, and wherein in a third one of said control states the switches (S1-SN) are put is a state so that at least two of said LED groups (D1, D2, . . . Dn) are mutually connected in parallel while also at least two of said LED groups (D1, D2, . . . Dn) are mutually connected in series;

wherein the device further comprises a memory (60) containing information defining n threshold levels (U1<U2< . . . <Un)

wherein the controller is configured to compare the momentary value of the DC input voltage (Vin) with said threshold levels;

wherein the controller (50) is configured to control the switches such that at all times the n LED groups are switched to a configuration of $n_P$ strings mutually coupled in parallel, each string containing $n_S$ LED groups mutually coupled in series, wherein $n_S$ is an integer number selected so that then $n_S$-th threshold level $U(n_S)$ is lower than the momentary value of the DC input voltage (Vin) while the $(n_S+1)$-th threshold level $U(n_S)$ is higher than the momentary value of the DC input voltage (Vin), wherein $$U(n_S) \leqq Vin < U(n_S+1)$$

and wherein $n_P$ is an integer number selected so that $n_P \cdot n_S \leqq n < (n_P+1) \cdot n_S$ applies;

wherein the switch matrix (30) comprises a plurality of n pairs of anode terminals (Ai) and cathode terminals (Ki) for connecting to the plurality of n LED groups (D1, D2, . . . Dn), and comprises a plurality of 3(n−1) individually controllable switches (S1 to S(3(n−1))) connected between the voltage input terminal (31) and the current input terminal (34) and connected to said anode terminals (Ai) and cathode terminals (Ki);

wherein the anode terminal (A1) of the first LED (D1) is connected to the first input terminal (31);

wherein the cathode terminal (Kn) of the n-th LED (Dn) is connected to the second input terminal (34);

wherein a controllable switch (S(3m−5)) is arranged between the anode terminal (Am) of the m-th LED (Dm) and the anode terminal (A(m−1)) of the (m−1)-th LED (D(m−1));

wherein a controllable switch (S(3m−4)) is arranged between the anode terminal (Am) of the m-th LED (Dm) and the cathode terminal (K(m−1)) of the (m−1)-th LED (D(m−1));

and wherein a controllable switch (S(3m−3)) is arranged between the cathode terminal (Km) of the m-th LED (Dm) and the cathode terminal (K(m−1)) of the (m−1)-th LED (D(m−1));

for all values of m between 2 and n.

2. The device according to claim 1, wherein each LED group has a forward voltage Vf, and wherein the i-th threshold voltage Ui is approximated as $Ui = i \cdot Vf + \gamma$ in which γ is a constant that represents the voltage drops over the switches in series with the LEDs plus the voltage drop over a shunt resistor and the current source.

3. The device according to claim 1, wherein each LED group has a nominal LED current $I_{LED}$, and wherein the controller (50) is adapted to control the current source (40) such that at all times the current I provided by the current source satisfies the relationship $I = n_P \cdot I_{LED}$.

4. The device according to claim 1, wherein each LED group has a nominal LED current $I_{LED}$, and wherein the controller (50) is adapted to control the current source (40) such that at all times the current I provided by the current source satisfies the relationship $I = n_P \cdot I_{LED} \times n/(n_P \cdot n_S)$.

5. The device according to claim 1, wherein those $n - n_P \cdot n_S$ LED groups not belonging to any of said strings are inoperative.

6. The device according to claim 1, wherein the controller (50) is configured to control the switch matrix (30) such that at least one of those $n - n_P \cdot n_S$ LED groups not belonging to any of said strings is coupled in parallel with one of said $n_P \cdot n_S$ LED groups of one of said strings.

7. The device according to claim 1, wherein, if the input voltage (Vin) is higher than a predetermined maximum threshold voltage (Vmax), the controller (50) is configured to control the current source (40) in such a way that the total power drawn by the device is constant.

* * * * *